US006808337B1

(12) United States Patent
Thomsen

(10) Patent No.: US 6,808,337 B1
(45) Date of Patent: Oct. 26, 2004

(54) VESSEL WITH VERTICALLY ELEVATIONAL SUPPORT LEGS

(75) Inventor: Kurt Elith Thomsen, Fredericia (DK)

(73) Assignee: A2Sea A/S, Fredericia (DK)

( * ) Notice: Subject to any disclaimer, the term of this patent is extended or adjusted under 35 U.S.C. 154(b) by 0 days.

(21) Appl. No.: 10/089,365

(22) PCT Filed: Sep. 28, 2000

(86) PCT No.: PCT/DK00/00532

§ 371 (c)(1),
(2), (4) Date: Apr. 12, 2002

(87) PCT Pub. No.: WO01/23252

PCT Pub. Date: Apr. 5, 2001

(30) Foreign Application Priority Data

Sep. 28, 1999 (DK) ..... 1999 01372
May 18, 2000 (DK) ..... 2000 00805

(51) Int. Cl.[7] ..... E02B 17/04; E02D 29/00

(52) U.S. Cl. ..... 405/203; 405/195.1; 405/196; 405/209; 114/264

(58) Field of Search ..... 405/195.1, 196, 405/198, 203, 206, 209; 114/258, 260, 264, 265; 175/5–8

(56) References Cited

U.S. PATENT DOCUMENTS 1,531,371 A * 3/1925 Belknap ..... 405/196
2,942,425 A * 6/1960 De Long et al. ..... 405/196
3,138,932 A * 6/1964 Kofahl et al. ..... 405/209
3,385,069 A * 5/1968 Estes ..... 405/196
3,575,005 A * 4/1971 Sumner ..... 405/196
3,716,993 A * 2/1973 Sumner ..... 405/198
4,040,265 A * 8/1977 Hellerman et al. ..... 405/196
4,041,711 A * 8/1977 Lucas ..... 405/197
4,065,934 A * 1/1978 Dysarz ..... 114/258
4,156,577 A 5/1979 McMakin
4,297,961 A 11/1981 Johnson, Jr.
4,456,404 A * 6/1984 Evans ..... 405/196
4,465,012 A 8/1984 Bos
4,473,256 A 9/1984 Collins
5,964,550 A * 10/1999 Blandford et al. ..... 405/224

FOREIGN PATENT DOCUMENTS

GB 2 120 607 A 12/1983
GB 2 275 909 A 9/1994
JP 600119811 * 2/1985 ..... 405/196

* cited by examiner

*Primary Examiner*—Jong-Suk (James) Lee
(74) *Attorney, Agent, or Firm*—William J. Sapone; Coleman Sudol Sapone, P.C.

(57) ABSTRACT

A vessel, preferably a chip, for transport and mounting of structures has a hull and at least four vertically elevated support legs and displacement apparatus for elevating the support legs so as to stabilize the ship for lifting heavy loads from the ship for mounting for example to a preinstalled base on the seabed.

8 Claims, 5 Drawing Sheets

VESSEL WITH VERTICALLY ELEVATIONAL SUPPORT LEGS

BACKGROUND

The invention relates to a vessel, preferably a ship, for transport and mounting of structures, said vessel comprising a hull and at least four vertically elevational support legs as well as displacement means for elevating the support legs.

Such a vessel is known from for instance GB-A-2,120,607. In this specification a ship is described which is used for installation of large offshore structures. The ship is equipped with four elevationally movable legs and a rail device on the deck of the ship. However, the ship is specially designed in the sense that the four elevational support legs form an integral part of the vessel and accordingly are mounted through its deck. Moreover, use of the rail structure means that the ship can only be used when a structure is extended outward from the deck and is to be arranged on a platform on a level with the deck's surface.

In connection with the mounting of windmills offshore it is furthermore known to transport same on a jack-up barge, which is towed out or which may perhaps sail on its own, and where only one mill at a time can be carried along, and where the speed of the transport unit is very limited. Such a jack-up is also very sensitive to wind conditions, for which reason it is only possible to erect the mills partly relatively dose to land and partly in relatively calm weather.

SUMMARY OF THE INVENTION

The object of the present invention is to provide a vessel which based on an existing vessel, i.e. complete with all gear, makes it possible to transport windmills and mount these mills on previously built structures on the seabed, and where the windmill erection itself will take place under the same conditions on land, and where the mounting may take place via cargo ships of the self-supplying type. The ship is in other words a unit which can handle all tasks comprising loading of the mill units, transport of several mill units to the mounting site, including lifting thereof from the cargo ship and lowering thereof to the preinstalled base on the seabed.

The ship is accordingly a cargo ship, preferably a container ship or a bulk carrier, to which certain structural additions have been made. The cargo ship distinguishes itself by holding a big cargo, which in this case will be up to 10 windmills, but at the same time also being highly seaworthy and able to maintain good speed, just as such a cargo ship holds the necessary facilities for the crew.

The object of the invention is achieved by a vessel of the type described in the preamble and where the support legs are furthermore mounted in at least two consoles which by first means are connected to the hull's right and left long side, respectively, and where the vessel also comprises at least one auxiliary structure, preferably a crane, for handling and placing the structures below the waterline.

The system accordingly functions by securing the mentioned consoles to know vessels by means of first mans which for example may be a rail device. Through each console there is mounted one preferably two elevationally movable legs, said legs ensuring that the ship will remain stationary, even in rough sea. It should be noted that in connection with the handling of the windmills a locking of the legs will take place in that the ship is raised to the necessary level, whereupon a blocking takes place since a high wave would otherwise give rise to instability during handling of the mills. By means of the crane itself it is thus possible to handle the large windmills, and where on the deck there may furthermore be mounted additional auxiliary cranes to ensure loading to and from the quay.

By providing a vessel according to the invention, the support legs will slide relatively frictionless in the sleeve which partially encloses the support legs. The sleeve may as disclosed be coated with a friction reducing substance, preferably in the form of teflon, or the support legs may be coated with teflon for achieving the same function. Furthermore, the legs are adapted for the sleeve via a sliding fit since it is important that there is not too much clearance between sleeve and support leg.

By providing a vessel according to the invention, an appropriate method for adjusting the vertical position of the support legs is achieved, since the hydraulic system will provide for the correct pressure on the support legs. It should also be noted that each support leg preferably has two wire winches mounted on either side thereof. The number of windings on the wire winch indicates that gear ratio where a gear of 9 is preferably preferred in such a manner that when the wire winch produces a 35 ton load, the pressure which is produced via a hydraulic station on each support leg may reach up to approximately 300 tons.

By providing a vessel according to the invention, the pressure on each individual support leg may be measured and indicated via the load cell.

By providing a vessel according to the invention, it is possible to adjust the weight in such a manner that when a corner exerts a high pressure on the load cells, such as disclosed in claim 4, they will send a message to the control system to change the pressure diagonally opposite this unit. This is accomplished by removing liquid from the chambers in this corner and by pumping in liquid in the diagonally opposite corner, thus achieving a form of equilibrium and compensating for the load weight that is moved. This anti-heeling system may be active both when the ship is floating and when it is anchored on the seabed via the support legs. In the first instance, a liquid sensor and gyro function will register heelings of the ship and a signal is transmitted from the sensor to the anti-heeling system, thus ensuring the stability of the ship.

In the latter instance, where the liquid sensors are not functioning, the load cells mounted on the support legs will register any pressure and any change of pressure on the support legs, when a load is moved, and will signal this information to the anti-heeling system, which is thus activated and compensates for the differences in pressure.

By providing a vessel according to the invention, an appropriate size of the console itself is achieved such that good control of the support legs within the longitudinal sleeve is achieved, said sleeve being located inside the console, or which is obtained by means of the holes which are cut in the upper and lower surfaces of the console to provide an aperture through the support legs may slide.

By providing a vessel according to the invention, the console will make up a removable unit which thus an be dismounted from/mounted on the structures of the known vessel.

BRIEF DESCRIPTION OF THE DRAWINGS

The invention will be further explained below with reference to the drawing wherein.

DETAILED DESCRIPTION OF THE INVENTION

Figure 1:
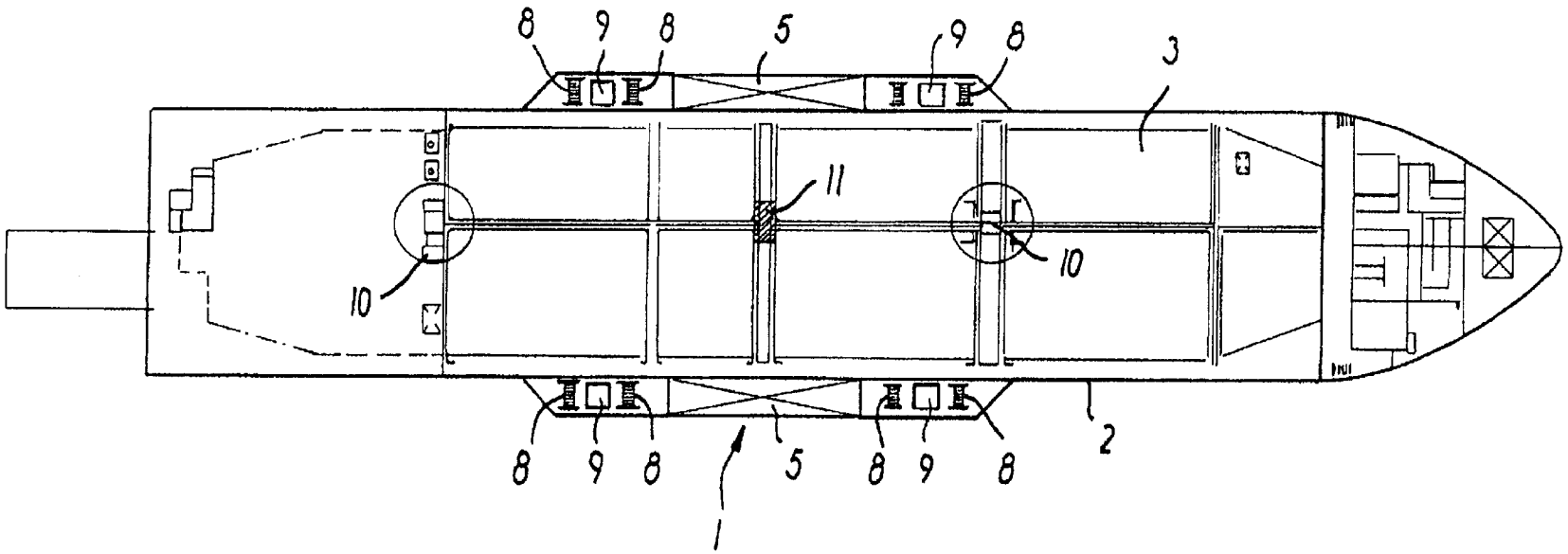
FIG. 1 is a top sectional view of a ship with tank/consoles mounted thereon with support legs and mounted cranes.

FIG. 1 shows a top view of a ship 1, comprising a hull 2, a deck 3, upon which deck two smaller auxiliary cranes 10 are positioned. On either side of the hull there is mounted a console 5, in which support legs 9 are placed, preferably two support legs at either end of the console. The support legs are on either side connected to a winch with wire 8, said wire winch providing for the right pressure on the support legs 9 via a hydraulic system.

The columns of the support legs are rectangular and end in a base in the order of 10 $m^2$ and are furthermore manufactured according to known principles.

The base itself is in the form of a plate and is arranged in a cardanic suspension such that its inclination adjusts to the slope of the seabed. The area of the support bases may be extended since they are detachably mounted on the support legs.

Between each pair positioned opposite each other on either side of the hull a large crane 11 is positioned, said crane being capable of lifting and mounting windmills to a previously mounted base on the seabed.

Furthermore, the ship comprises additional cranes 10, since cargo ships are known to have smaller cranes which are positioned at either end of the ship, which cranes can be used for ordinary loading, and which may, if required, be used during the lowering of the mill itself, since these act as guides for the mill wings.

The ship comprises a large crane which has a loading capacity of about 450 tons. This crane is taken from known, so-called caterpillar cranes where the movable part is removed, and the crane is accordingly mounted stationarily on the ship's deck, in that the crane is positioned in the middle of the longitudinal direction of the ship, preferably halfway between two support legs positioned opposite each other and on either side of the hull, but displaced or displaceable, however, to one or the other side of the longitudinal side of the ship. On the ship there is mounted a 12 meter tower on which the crane is positioned, whereby the crane reaches a height which makes it possible to handle the extremely high windmills.

Figure 2:
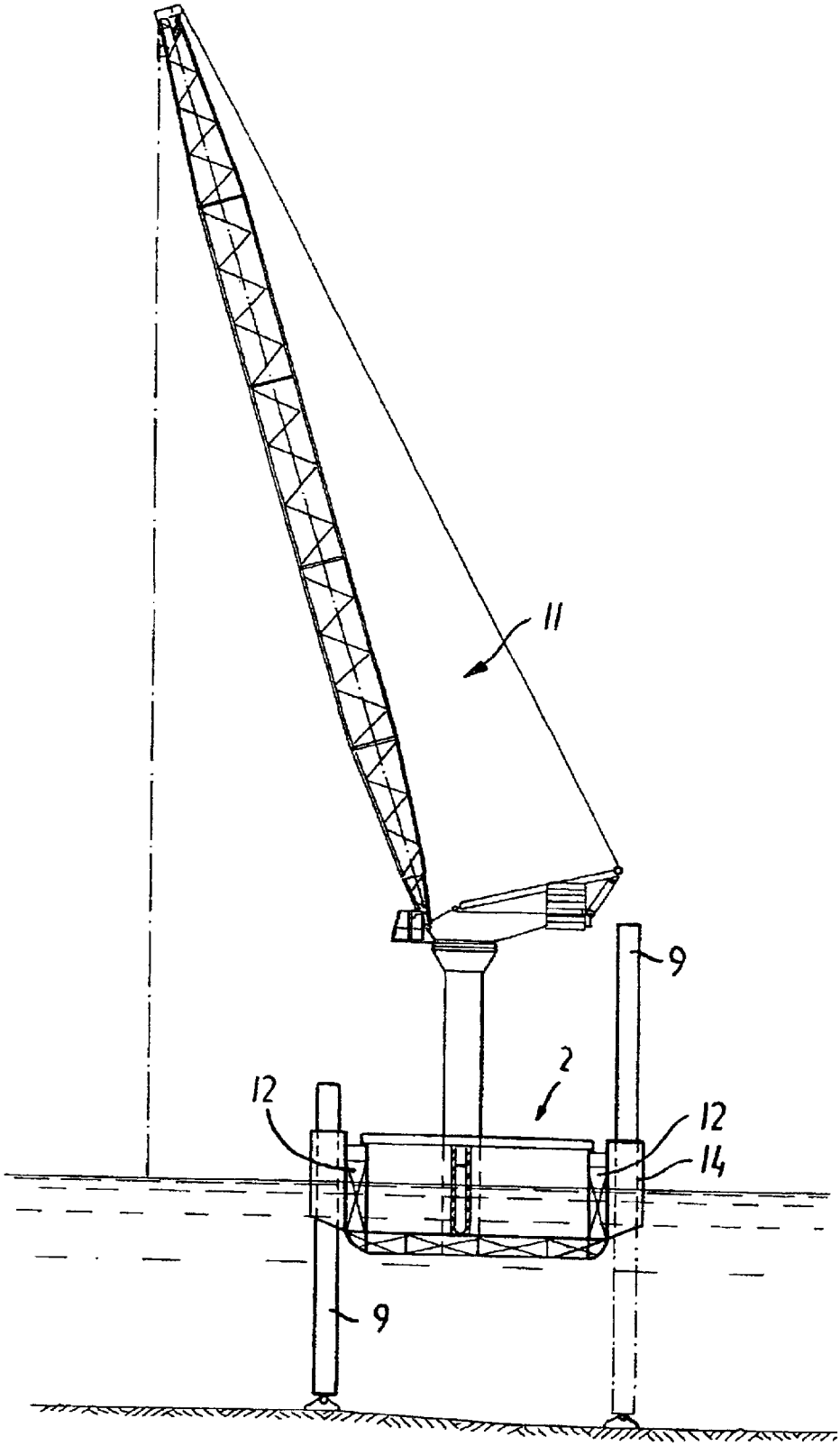
FIG. 2 is a cross section of a crane mounted on a ship.

FIG. 2 shows a side view of the crane 11, from which it appears that same is displaced towards one of the long sides of the ship. FIG. 2 also shows pockets in the sides of the hull itself, said pockets 12 forming part of the anti-heeling system, and which can also be coupled with the functioning of the large crane 11. The anti-heeling system is primarily built in to bring about a counterbalance to the moment of the smaller cranes during operation in that these chambers, which the anti-heeling systems normally cooperate with, are filled with water diagonally opposite the side wherein a crane is working so that the ship does not tip. This anti-heeling system has thus in a novel manner become activated in connection with the use of the large crane in that a control system has been built in, said control system being connected to load cells placed on the support legs and, if desired, at each support base, and said load cells registering changes in the pressure on the individual leg. In the cases where a load cell for example indicates pressure on a leg of around 350 tons and changed e.g. from 200 tons, the load cell will send a message to the control system regarding a change diagonally opposite this unit by removing liquid in the 350 tons corner from the anti-heeling system and by pumping in liquid in the diagonally opposite corner so that a form of equilibrium is achieved.

The system may be controlled via a computer program, or it may be handled purely manually. It should be noted that the ship with the built-in support legs and crane is designed to be capable of operating in a 3 meter actual wave height, which corresponds to 1½ meters significant wave, since it is essential by the structure that it can be held plane under the forces existing by such a wave condition. What decides whether or not it is possible to erect a mill will therefore not be the sea conditions, but on the contrary the actual wind conditions, and said wind conditions will be the same as are existing on land.

In the cases where an actual wave height is in excess of 3 m, the pressure on a support leg will be in excess of 300 tons, so that the support leg with the actual dimensions cannot be held stable. The support leg can naturally by giving the wire winch more windings achieve a higher pressure effect, but this is not relevant since a heavier sea will imply a higher wind force, and where this wind force is so high that the windmill cannot be positioned, since in that case the wind will exert too great a pressure on the wings of the windmill itself.

Furthermore, the structure comprises load cells 13 which are attached to each support leg 9, in that each support leg 9 also extends within a sleeve 14 and is coated with teflon to create less friction resistance.

Figure 3:
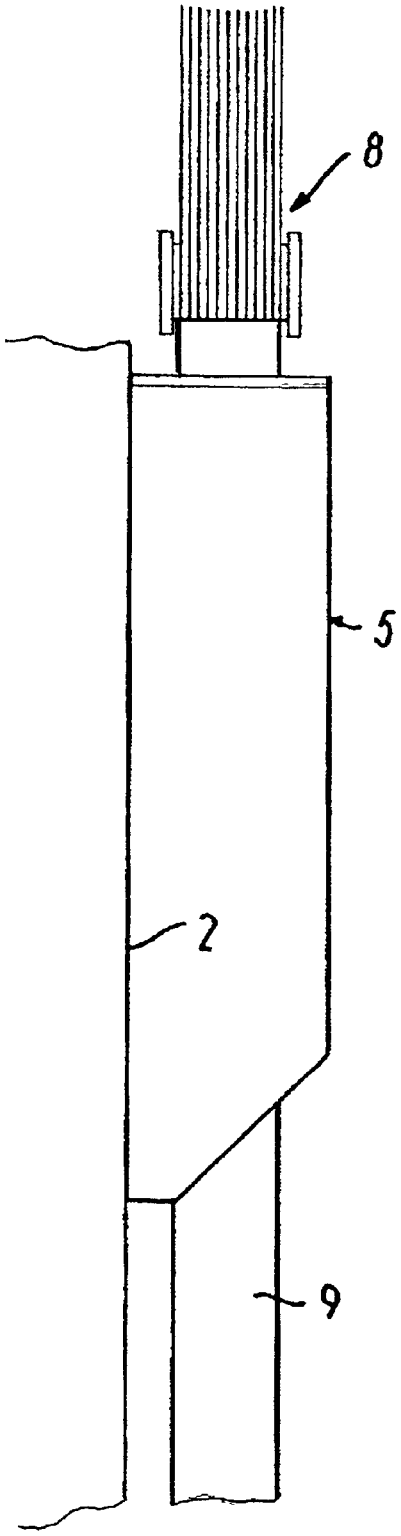
FIG. 3 is the position of the support leg in relation to the tank/console and the winch therefore.
Figure 4:
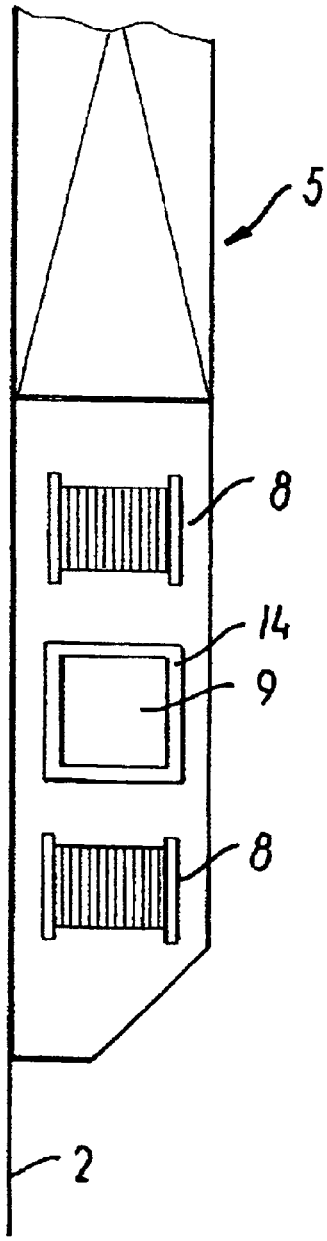
FIG. 4 is a top view of the tank/console with winch and support leg shown in FIG. 3.
Figure 5:
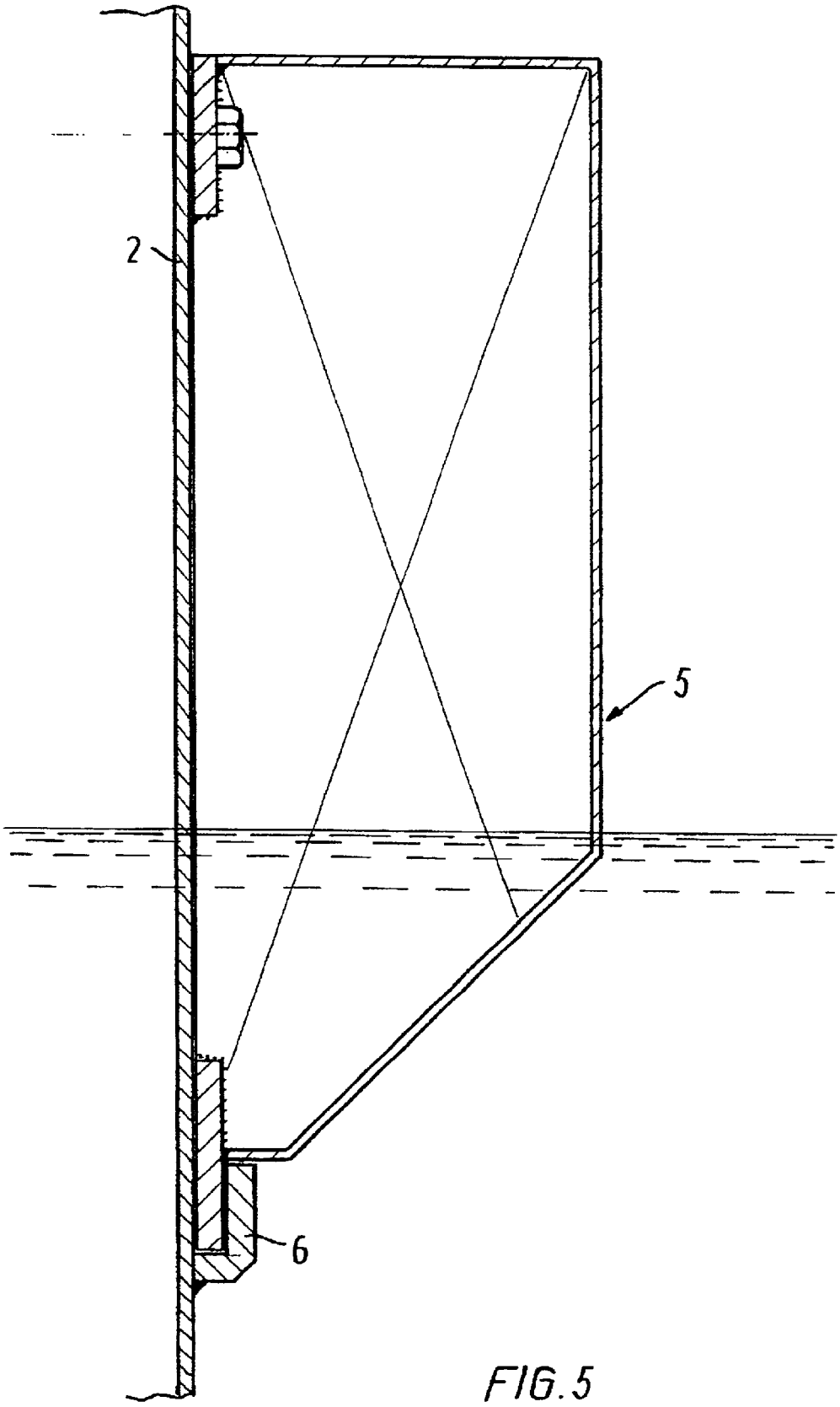
FIG. 5 is a cross section through the tank with support leg mounted on the side of the ship.

FIG. 3 is a side view of the tank/console 5 and through which a support leg, preferably two, are positioned, in that at least one, preferably two, wire winches 8 are attached to each support leg. This is furthermore seen in FIG. 4, from which it is apparent that the console 5 encloses the support legs 9 within their sleeve 14, and where the mentioned winches 8 are arranged on either side, whereas FIG. 5 shows a cross section through the console 5, said console being removably mounted to the hull 2, in that to the hull's long sides there is welded a longitudinal rail 6, which is L- to V-shaped, and into the recess of which a plate portion from the tank rests and where the top end of the tank via a bolt is mounted on the cargo ship. Through this tank/console 5 the support leg 9 is accordingly positioned. The tank ends at the top on a level with the deck/rail, whereas the lower portion is substantially below the water line. During the mounting of a windmill the ship will thus on all four legs exert a pressure of 300 tons, which will lift up the ship, whereafter the winch is locked such that a possible wave will not give rise to instability. If the winch is not locked, a pressure equalisation will take place via the function attached to each leg so that the instability is neutralised. Each leg has a length of approximately 20 m.

Mounting of the consoles takes place by a bolted joint which is put in the hull by each so-called web frame, with a bolt on either side.

The hollow space between the hull and the consoles on the slanted surface immediately below deck level is treated with Chockfast, a highly adhesive friction substance, which thus transfers forces from support legs and consoles to the hull over a significantly larger carrying surface than by exclusively using a bolted joint where only the stress resultant of the bolted joint can be taken into account.

The rail connection itself at the base of the consoles is provided to hold the consoles in the correct position the whole time and functions therefore only as a hinge in that it prevents the consoles from tipping out from the hull. Accordingly, it does not carry the ship at all.

By the above described product the ship will be lifted out of the water to such an extent that waves up to a certain size will have no influence on the ship.

All other systems lift the floating object all the way out of the water with the drawbacks associated therewith, in that those systems, so-called jack-ups, are highly sensitive at the moment when the bottom of the object just leaves or meets the surface of the sea, if there are waves, so that it can take long time between removal from one operational place to another, in this case from mill to mill, whereof erection of 50 mills may well be planned.

Figure 6A:
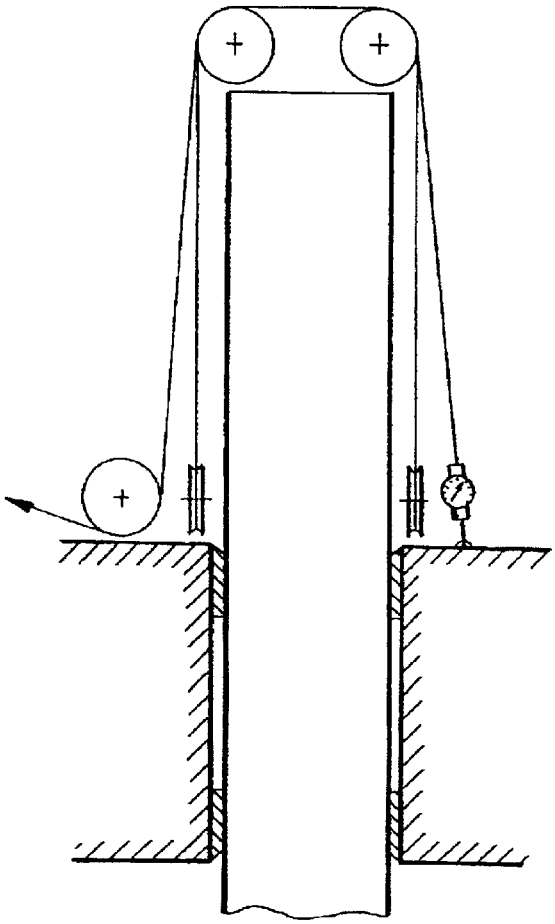
FIGS. 6A–C is the interaction of wire winch and support leg.

FIG. 6A shows how a wire winch presses the leg against the bottom, one end of the wire being fastened to the support leg, and the other end being mounted on a hydraulic winch with automatic tightening (tension), which is normally used for mooring winches on larger ships.

When the ship is at the position, the legs are lowered to the bottom of the sea, and the ship is lifted so much that it is not moving. Then the winches are set to tension so that the ship may follow the rising and falling tide. Sufficient lift will normally be at about 5% of the ship's displacement. When the accurate mounting itself is to be made, the legs are locked and the pressure of the legs controlled by the trim system of the ship such that the heeling moment from the load hanging in the crane is equalized by ballast water, which is moved in the opposite direction.

When practically applied, the anti-heeling system is put out of action at the moment when the support legs are put down. This happens because the system functions by means of impulses from the ship's heeling sensors in such a manner that it will compensate by working opposite the signals thereof, but since the ship does not heel, the system will not receive any signals.

The load cells register the change in pressure which is stored in a control panel. The operator or the administrative control system continuously controls the pressure on each of the 4 legs and thus decides if there is to be a redistribution of the ballast of the ship.

These sensors are bypassed by mounting load cells on each support leg. Via an Ethernet connection—since the load cell gives an electric signal similarly to said sensors—the anti-heeling system of the ship may again receive impulses corresponding to those given by the heeling sensors. In this way, the anti-heeling system may be manipulated into thinking that the ship is heeling, which is clearly not the case, and will therefore compensate for the moved load.

In principle, there is no connection between the winches and the load cells since the winches are mooring winches functioning by giving a constant hydraulic pressure. If the resistance in the wire declines, the winch will start to haul in, and vice versa, if the resistance in the wire rises to a level higher than the hydraulic pressure, then the winch will ease off the wire until the original pressure is established. This is brought about by means of a kind of excess pressure valve which respectively shuts off and opens for the flow of oil.

Figure 6C:
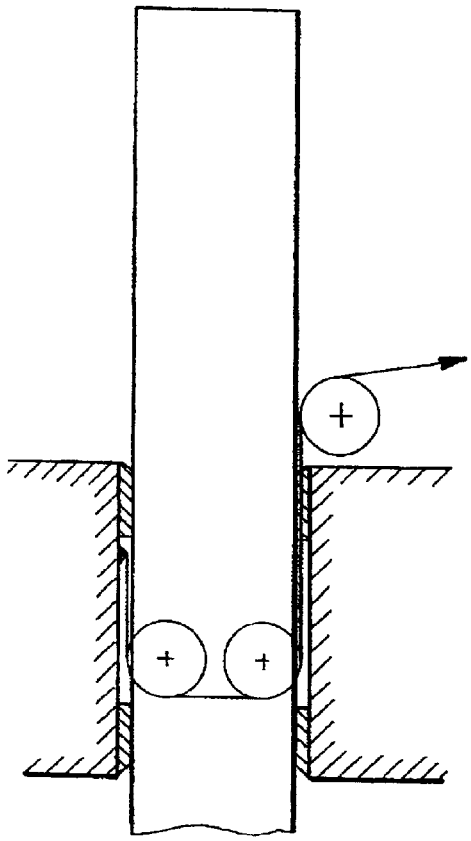
Figure 6B:
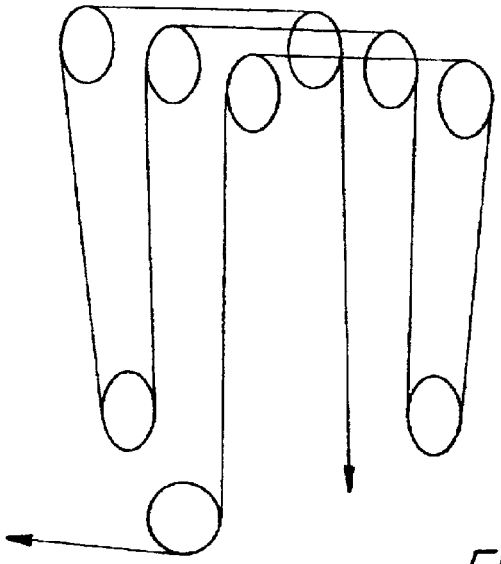

FIG. 6B shows how the wire is cut for pressure, but a combination of winch size and number of cuttings may be adjusted to any ship.

The drawing, FIG. 6C, shows the lift system where the hydraulic winch also is likewise a tension winch, but only with the function of holding the wire taut in all situations.

What is claimed is:

1. A ship for transport and mounting of structures, said ship (1) comprising a hull (2) having at least four vertically movable support legs (9) engaged thereto and displacement means for moving the support legs (9) upward and downward relative to the hull (2), the support legs (9) mounted in at least two consoles (5) fixedly mounted to a right side and a left side of the hull by first means, the ship having at least one crane (11), for handling and placing the structures, the displacement means adjusting the position of the support legs (9) for lifting the ship (1) attached thereto to such an extent that waves up to a certain preselected size do not destabilize the ship (1), during the handling and placing of the structures by the crane, with a bottom of the ship remaining below sea surface.

2. The ship according to claim 1 wherein the consoles (5) comprise at least one sleeve (14) coated with a friction reducing substance on an inner surface thereof, said inner surface enclosing a portion of an outer circumference of a support leg (9).

3. The ship according to claim 1 wherein the displacement means comprise at least one wire winch (8) attached to each of said support legs (9) and a hydraulic system attached thereto.

4. The ship according to claim 1 wherein the support legs each comprise load cells (13).

5. The ship according to claim 1 further comprising hollow spaces or chambers (12) in the hull (2) and a control system, said hollow spaces or chambers being filled with or emptied of water via the control system.

6. The ship according claim 1 wherein an upper end surface of each console (5) is placed on a level with a deck (4) of the ship.

7. The ship according to claim 1 wherein a lower end surface of each console (5) is placed at a level distant from a waterline of the ship, between the waterline and a bottom of the ship.

8. The ship according to claim 1 wherein in the first means comprise a rail secured to the hull and fastening means.

* * * * *